United States Patent [19]

Hart et al.

[11] 4,103,296

[45] Jul. 25, 1978

[54] COULOMETRIC ELECTROLYTIC TIMING DEVICE WITH COAXIALLY ALIGNED ELECTRODES

[75] Inventors: William A. Hart, Allentown; James J. Klinikowski, Whitehall, both of Pa.

[73] Assignee: Air Products & Chemicals, Inc., Allentown, Pa.

[21] Appl. No.: 816,611

[22] Filed: Jul. 18, 1977

[51] Int. Cl.[2] ..... G08B 1/00

[52] U.S. Cl. ..... 340/309.1; 340/309.4; 324/182

[58] Field of Search ..... 340/309.1; 324/182; 317/230; 307/310

[56] References Cited

U.S. PATENT DOCUMENTS 3,974,495 8/1976 Jones ..... 340/309.1

*Primary Examiner*—Harold I. Pitts

*Attorney, Agent, or Firm*—Russell L. Brewer; Barry Moyerman

[57] ABSTRACT

A coulometric timing device having improved reliability. A cylindrical sleeve, a solid, cylindrical, electrically conductive rod coaxially aligned within the sleeve, an electrolyte between the rod and sleeve and means for retaining the electrolyte within the sleeve is shown.

7 Claims, 1 Drawing Figure

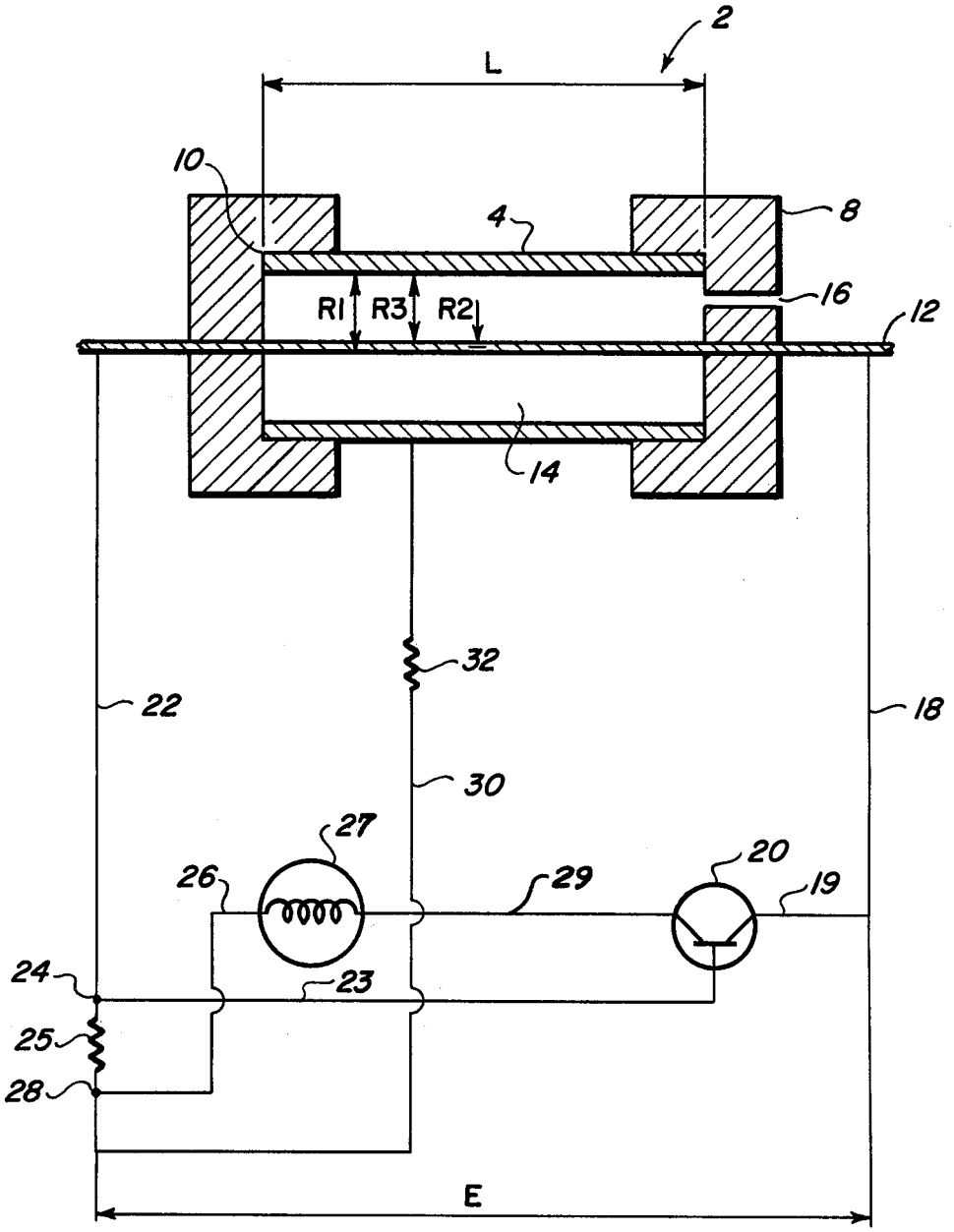
2
L
10
4
8
16
12
R1
R3
R2
14
32
22
18
30
27
20
26
29
19
24
23
25
28
E

COULOMETRIC ELECTROLYTIC TIMING DEVICE WITH COAXIALLY ALIGNED ELECTRODES

BACKGROUND OF THE INVENTION

1. Field of the Invention

This invention relates to coulometric electrolytic timing devices and more particularly to timing devices for designating an elapsed time period in response to current flow through an electrolytic solution.

2. Description of the Prior Art

U.S. Pat. No. 1,254,939 discloses a coulometric timing device having a cylindrical sleeve and a small hollow, cylindrical member coaxially aligned with the cylindrical sleeve which is filled and supported by a nonconductive material. A conductor is passed through the nonconductive material and a voltage applied to convert the cylindrical sleeve to a cathode and the hollow member to an anode whereby the anode plates away and onto the cathode. When the anode is completely plated away, heat is generated and causes the nonconductive material to melt and seal the conductive wire. When current flow stops, an alarm is activated.

U.S. Pat. No. 2,791,473 discloses a regenerable elapsed time indicator having an anode and cathode section with an electrolyte therebetween. When the metal is exhausted from the anode and metallic ions are depleted from the electrolyte, the voltage necessary for maintaining the current increases and activates the alarm unit.

U.S. Pat. No. 3,029,384 discloses an elapsed time indicator utilizing a dual coiled spring assembly with one spring coupled to a pointer. When an electrical circuit is established, metal from one spring is plated away and the pointer moves in response to the weakening of the spring to indicate an elapsed period of time.

U.S. Pat. No. 3,609,622 discloses a spirally-wound heater which is vaporized to deposit metallic ions onto a plurality of metallic bands. When sufficient metal has vaporized from the spiral heater and deposited between the metallic bands, the resistance between these bands are reduced. When a certain minimum resistance level is obtained the circuit is activated.

U.S. Pat. No. 3,355,731 discloses the use of a calibrated wire disposed within a cylindrical cathode perpendicular to the longitudinal axis. When the wire completely erodes away, the circuit is broken and the alarm circuit is activated.

U.S. Pat. No. 3,711,751 discloses an electrolytic timing device having a U-shaped anode portion within a cylindrical housing. The U-shaped anode allegedly achieved greater precision than other timing devices because of its ability to focus the removal of metal at a particular location, i.e., the arcuate portion of the U.

SUMMARY OF THE INVENTION

This invention relates to an improved coulometric electrolytic timing device adapted for use in electrical circuits for detecting the rupture of a circuit conductive path after a predetermined time period, said rupture caused by the electroplating away of an electrode in said conductive path. The improvement comprises:

(a) a conductive cylindrical sleeve, (b) an electrically conductive, solid, cylindrical rod, coaxially aligned and disposed within said sleeve;

(c) nonconductive support means for engaging said rod and maintaining said rod in coaxial alignment within said sleeve;

(d) an electrolyte disposed between said rod and said sleeve;

(e) sealing means for retaining said electrolyte within said sleeve.

The elapsed time indicator of this invention has significant advantages, because of its particular design, over previous elapsed time indicators. These advantages include:

a timing device which is very easy to manufacture and assemble;

a timing device which can be easily machined to extremely close tolerances to generate a precision instrument;

a timing device which has an anode portion which erodes substantially equally from all sides over its entire length and thus on rupture completely breaks away to eliminate possible establishment of a circuit between electrode segments as often happens where the removal of metal is effected through a focusing effect;

a timing device which has outstanding accuracy at both high and low plating rates;

a timing device, which because of the choices of electrolyte, insures that on rupture of the anode sufficient voltage is generated to activate the signal lamp or alarm circuit.

BRIEF DESCRIPTION OF THE DRAWING

The single embodiment represents an alarm circuit showing the electrolytic timing device in cross section within the alarm circuit.

DESCRIPTION OF THE PREFERRED EMBODIMENTS

The timing device 2 comprises an outer electrically conductive, cylindrical sleeve 4 which may be made of copper or other conventional metal for example. The cylindrical sleeve 4 in the device forms a cathode electrode.

Nonconductive sealing caps 8 and 10 are disposed over the ends of cylindrical sleeve 4 for retaining a solid, electrically conductive cylindrical anode 12 in coaxial alignment within cylindrical sleeve 4. Anode 12 is sealingly engaged within sleeve 4 so that along its external surface and over its effective length L, the distance $R_3$ is substantially uniform. In this way substantially uniform plating away of anode 12 along length L is achieved so that on rupture the anode portion within length L falls away to leave only tip portions retained by sealing caps 8 and 10.

An electrolyte 14 is disposed between anode 12 and cylindrical sleeve 4 for providing electrical communication therebetween. It is introduced to sleeve 4 through hole 16 in sealing cap 8. The electrolyte utilized can be any conventional electrolyte normally used in timing devices. However, a preferred composition contains copper fluoborate, water and ethylene glycol. The preferred compositions are defined within the four corners of an envelope shown in a 3 component diagram and have the following points.

| | A | B | C | D |
|---|---|---|---|---|
| Ethylene Glycol | 97.5% | 87% | 65% | 62% |
| Copper Fluoborate | 1.5% | 6% | 1.5% | 6% |

-continued

| | A | B | C | D |
|---|---|---|---|---|
| Water | 1.0% | 7% | 33.5% | 32% |

This particular electrolyte has a sufficiently high resistivity so that when rupture occurs a signal which is of sufficient intensity for establishing electrical communication necessarily activates the alarm. On the other hand, the resistivity is not so high that poor plating results.

In designing the electrolytic timing device to achieve excellent reproducibility in the alarm circuit, the effective length L is generally equal to about $2R_1$. ($R_1$ is the radius of the cathode.) Typically, L is from about $1\text{-}4R_1$. With respect to the anode portion, $R_1$ is designed so that it is generally equal to at least $2R_2$ ($R_2$ is the radius of the anode) and usually 2–14 $R_2$. In terms of actual numbers, L is generally from about 1/4 to 1½ inches, $R_1$ is from about 1/16 to ¾ inches, $R_2$ of the anode portion is from about 0.01 to 0.2 inches.

One of the reasons for creating a timing device whereby the length L is equal to or greater than $R_1$ is to prevent the possibility of an intermitted circuit which can be formed between end or tip portions of the ruptured anode, or between the tip portions and cathode. By maintaining this effective length, the possibility of establishing a circuit without activating the alarm system is eliminated. Further effort to reduce the possibility of establishing a circuit between the anode and cathode is made by maintaining $R_1$ at least about equal to $R_2$. If $R_1$ were substantially less than $R_2$, a circuit might develop between the ruptured end portions of the anode and the surface of the cathode and the voltage to effect this circuit would not be sufficient to activate the alarm circuit. In actual practice, the radius, $R_1$ of the cylindrical sleeve cathode is from about ⅛ to ¾ inches and the radius $R_2$ of the anode is from about 0.01 to about 0.2 inches.

In viewing the remainder of the alarm circuit, an electrical lead 18 is connected to one end of anode 12 and to lead 19 which is connected to transistor 20. Another electrical lead 22 is coupled to the other end of anode 12 and to lead 23 which is coupled to the negative side of transistor 20. Both lead 22 and 23 are coupled at point 24 and then coupled to one end of resistor 25 which is used for controlling the electrical current. One end of lead 26 is connected to a signal light 27 or other alarm circuit, and the other end of lead 26 is coupled to resistor 25 at point 28. Lead 29 is connected to the signal lamp 27 and transistor 20. Another lead 30 is coupled to lead 22 at one end, to resistor 32 and then with cylindrical sleeve 4 at the other end. A voltage then is applied between leads 18 and 22 to effect plating of the anode onto the surface of the cathode.

Although not intending to be bound by theory, it is believed one of the reasons for the success of the electrolytic timing device of this invention, at both high and low plating rates, is the fact that there can be no focusing or shielding of a particular surface of the anode from plating action. Given that focusing has been substantially eliminated by the particular design and that plating is substantially uniform along the entire effective length of the anode, the unit on rupture completely falls away to prevent current flow. In the older style models where there was a focusing effect, i.e., in those cases where the anode was in the shape of a U, a coil of spring, or the anode placed perpendicular to the axis of the cathode, plating often was not uniform, and the anode did not fall away completely. Often some parts of the anode had sufficient strength, because of a larger cross-sectional area on initial rupture to permit arcing and/or current flow on an intermittent basis. As a result, the signal light had a tendency to flash or the signal was not sufficiently strong to activate the alarm circuit even though a rupture had occurred.

The following examples are provided to illustrate preferred embodiments of this invention and are not intended to restrict the scope thereof.

EXAMPLE 1

Several electrolytic timing devices or capsules were prepared by cutting ½ inch sections ± 0.002 inches of ⅜ inch copper tubing. Anode sections of 0.04 inch diameter copper wire were coaxially aligned with and inserted into the ½ inch copper tubing sections and sealingly engaged and retained therein by the use of methyl methacrylate caps. These caps then were mounted on the respective ends of the copper sleeve. The caps were appropriately machined so that the surface of copper wire was substantially equidistant over its effective length from the internal surface of the copper sleeve.

An electrolyte was formed by mixing two volume parts of aqueous 45% copper II tetrafluoborate with three volumes ethylene glycol. Then one volume of the copper fluoborate-ethylene glycol-water solution were added to seven volumes ethylene glycol and this resultant electrolyte added to the timing device. The resultant electrolyte was formulated so that the voltage required to establish a circuit between the ends of the anode at the time of rupture was such that the transistor would be activated sufficiently for engaging the alarm or signal light. In addition, the resistivity of the electrolyte was not so high as to prevent good plating. Of course the resistivity of the electrolyte could be increased or decreased as required so that on rupture of the anode the voltage would be sufficient to activate the alarm.

When ten of these electrolytic timing devices were tested at a plating rate to give a calculated elapsed time of approximately 100 hours, the average time of initial failure* was 94.23 hours, and the average time of final failure* was 95.3 hours. The maximum deviation from the mean was 2.96%. The span of time from the first to the last to fail on initial failure, based on the average, was equal to about 5.5%. The span of time from the first to the last to fail on final failure, based on the average, was about 5.4%.

Generally when the span of time between the first to actuate the alarm and the last to activate the alarm is within 10% of the average, the results are deemed excellent. Rarely have we observed standard prior art electrolylic timing devices to exhibit less than 20% deviation from the time of the first to fail to the last to fail.

Initial failure* is that point where there is a detectable voltage increase in the circuit (as measured across the capsule from wires 22-18).

Final failure* is that point when the voltage is sufficient to activate the alarm.

EXAMPLE II

Electrolytic timing devices were prepared in accordance with the method of Example I and tested in a non-simulated environment. The average time of initial failure of these units was 101.01 hrs. with the first failing at 94.92 hours and the last failing at 104.8 hours. The average time of final failure was 101.46 hours with the first to fail at 94.92 and the last to fail at 104.87.

Based on the average, the span of time from first to last to fail on initial failure was approximately 9.8% and the span of time from the first to the last to fail on final failure was 9.81%. The maximum percent deviation from the mean was 6% with the average percent deviation from the mean being approximately 2.8%. One of the reasons for the higher percentage of deviation than in Example 1 is due to electrical inconsistencies in the circuit. It was interesting to note that in this particular series the time of initial failure to the time of final failure was the same in eight of the ten timing devices. The maximum difference was 3 hours. On examination, the electrodes had completely fallen away and it is for this reason that initial and final failure were essentially the same.

What is claimed is:

1. In a coulometric electrolytic timing device adapted for use in electrical circuits for detecting the rupture of a circuit conductive path after a predetermined time period, said rupture caused by the electroplating away of an electrode in said conductive path the improvement which comprises:

(a) an electrically conductive cylindrical sleeve, (b) an electrically conductive, solid, cylindrical rod coaxially aligned and disposed within said sleeve, (c) nonconductive support means for engaging said rod and maintaining said rod in coaxial alignment within said sleeve;

(d) an electrolyte disposed between said rod and said sleeve;

(e) sealing means for retaining said electrolyte within said sleeve.

2. The timing device of claim 1 wherein the sleeve has a radius $R_1$ and the rod has a radius $R_2$ and $R_1$ is from about 2–14 $R_2$.

3. The timing device of claim 2 wherein the sleeve has an effective length L and L is from about 1–4 $R_1$.

4. The timing device of claim 3 wherein L is from about $\frac{1}{4}$ to about $1\frac{1}{2}$ inches, $R_1$ is from about $\frac{1}{8}$ to about $\frac{3}{4}$ inches, and $R_2$ is from about 0.01 to 0.22 inches.

5. In an alarm circuit including a timing device and an electrical alarm indicator which is activated by the failure of an electrode in an electrical time circuit after a predetermined elapsed period of time, the improvement for enhancing the reliability of the alarm circuit which comprises the electrical timing device of claim 1.

6. The alarm circuit of claim 5 wherein the electrolyte in the timing device has a resistivity such that on rupture of electrode, the voltage necessary to establish an electrical circuit is sufficient to activate the alarm, but such resistivity being sufficiently low to permit plating away of the anode.

7. The alarm circuit of claim 5 wherein said electrolyte in said timing device is within the four corners of the boundary formed in a three component diagram by the points A, B, C and D where A, B, C and D have the following composition:

| | A | B | C | D |
|---|---|---|---|---|
| Ethylene Glycol | 97.5% | 87% | 65% | 62% |
| Copper Fluoborate | 1.5% | 6% | 1.5% | 6% |
| Water | 1.0% | 7% | 33.5% | 32% |

* * * * *